United States Patent [19]

Lomangino

[11] Patent Number: 4,841,262

[45] Date of Patent: Jun. 20, 1989

[54] RADIO FREQUENCY POWER MODIFICATION WITHOUT PHASE SHIFT

[75] Inventor: Michael Lomangino, Dix Hills, N.Y.

[73] Assignee: United Technologies Corporation, Hartford, Conn.

[21] Appl. No.: 888,676

[22] Filed: Jul. 24, 1986

[51] Int. Cl.[4] ..... H01P 1/22; H01P 5/12

[52] U.S. Cl. ..... 333/81 R; 333/117

[58] Field of Search ..... 333/81 R, 24.2, 109, 333/110, 117, 139

[56] References Cited

U.S. PATENT DOCUMENTS 3,323,080 5/1967 Schwelb et al. ..... 333/81 R

*Primary Examiner*—Thomas H. Tarcza

*Assistant Examiner*—Gregory C. Issing

[57] ABSTRACT

A radio frequency power and voltage modification arrangement (13) including first and second power channels (28 and 29) both electrically connected between first and second hybrid elements (15 and 16), power in said first and second hybrid elements (15, 16) being subject to respective controllable, oppositely signed phase shifts applied to said respective channels (15, 16), for modifying the power output from the arrangement (13) as a function of the cosine of the applied phase modification, without any phase modification between input and output power and voltage.

2 Claims, 2 Drawing Sheets

RADIO FREQUENCY POWER MODIFICATION WITHOUT PHASE SHIFT

TECHNICAL FIELD

The technical field of the invention herein is that of attenuator arrangements for use in radio frequency (RF) electronics systems and more particularly, that of attenuator arrangements for use in phased array radar systems.

BACKGROUND ART

Many kinds of radio frequency systems and components in current use are employed for the control of power and voltage levels in complex electronic systems and arrangements. In most such cases, when the power level in such arrangements is reduced, there is, however, an associated change of phase impressed upon the affected radio frequency waveform.

This phase alteration is generally undesirable. Accordingly, an object of the invention herein is to establish a nonphase-shifting attentuator arrangement, which can be used successfully in modifying and/or attenuating the voltage and power levels in complex electronics systems and arrangements.

Other objects of the invention are apparent in the detailed discussion of the invention provided herein.

DISCLOSURE OF INVENTION

According to the invention herein, the level of power transmitted in a microwve RF attenuator arrangement is modified without there being an accompanying change in the phase of the output signal from the attenuator arrangement.

In particular, the invention herein establishes the design of an attenuator arrangement which controls the amplitude of a transmitted RF signal without varying its phase. This is accomplished by programming equal but opposite phase shifts into each of two phase shifters used in first and second branches of the attenuator arrangement.

According to another version of the invention, a pair of RF amplifiers are introduced in the first and second branches of the attenuator arrangement. These preferably operate under saturation conditions in order to ensure the control of amplitude of the RF signal without variation in its phase.

Other features and advantages of the invention will be apparent from the specification and claims and from the accompanying drawings which illustrate a best version or embodiment of the invention.

BEST MODE FOR CARRYING OUT THE INVENTION

Figure 1:
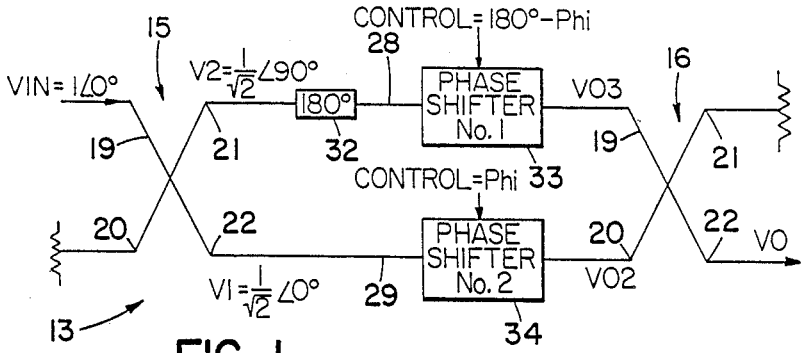
FIG. 1 is a schematic illustration of one version of the attenuator arrangement according to the invention herein, with the output voltage taken at a first selected output branch of the output hybrid element.

FIG. 1 in particular shows the power attenuator arrangement 13 according to the invention herein. This attenuator arrangement 13 includes first and second hybrid elements 15 and 16 as can be seen. Further, each hybrid elements 15 and 16 includes four ports, the first of which are respectively labeled ports 19 and 19' and constitute the respective input sides of respective hybrid elements 15 and 16. Hybrid element 15 further includes a terminated second port 20 which is also on the input side thereof. Hybrid element 15 further includes a third branch 21 which connects electrically to a first or upper channel 28 of attenuator 13 for communication of power. Hybrid element 15 further includes a fourth port 22 which is connected electrically to a second or power channel 29 of attenuator 13. Attenuator 13 further includes in hybrid element 16, a second port 20' which is, in turn, connected to a second channel 29 leading to fourth branch 22 of element 15. Hybrid element 16 further includes a third branch 21' which is terminated in the same fashion as branch 20 of element 15. Finally, hybrid element 16 includes output port 22'.

In short, attenuator 13 includes upper and lower branches 28 and 29 between respective legs 19' and 21 and legs 20' and 22 of attenuator 13. Upper branch 28 includes a fixed 180 degree phase shifter 32 and a variable phase shifter 33 which provides a selected polarity (in this case, a negative) phase shift of magnitude "phi" with respect to a preset reference of 180 degrees. The second branch 29 of attenuator 13 includes a phase shifter 34 which produces a selected opposite polarity, in this case, positive phase shift of magnitude "phi".

Figure 2A:
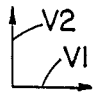
FIGS. 2A through 2C are vector diagrams of hypothetical voltage and/or power signals passing through first and second transmission branches of the attenuator arrangement shown in FIG. 1.
Figure 2B:
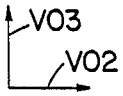
Figure 2C:
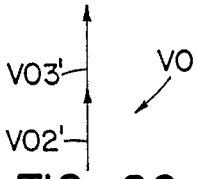

To explain the general operation of attenuator 13, FIG. 2A shows voltages V2 and V1 at respective outputs 21 and 22 of first hybrid element 15. For a unity input voltage level VIN at port 19 set to zero phase, the output voltages V2 and V1 of element 15 are 90 degrees out of phase, with V2 being ninety (90) degrees out of phase with VIN, and both V2 and V1 being reduced in amplitude to 0.707 of the magnitude of VIN. With phase shifters 33 and 34 set such that phi=0° for channels 28 and 29 (that is with phase shifters 32 and 33 each, for example, producing 180 degrees of shift and phase shifter 34 producing a zero (0) phase shift), voltages VO3 and VO2 to hybrid 16 at the respective ports 19' and 20'' are maintained at the same level and phase as V2 and V1, respectively, as is apparent by comparing FIGS. 2A and 2B. The output contributions of VO3 and VO2 are precisely aligned to be in phase for complete additive combination in hybrid 16 for production at output 22'.

Figure 3A:
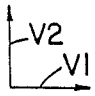
FIGS. 3A through 3C are vector diagrams of the voltage/power signals set forth in corresponding FIGS. 2A through 2C above, with the transmission branches subject to selected equal but opposite phase shifts.
Figure 3B:
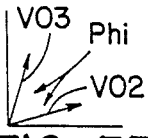
Figure 3C:
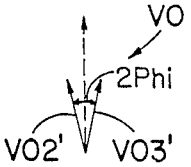
Figure 4:
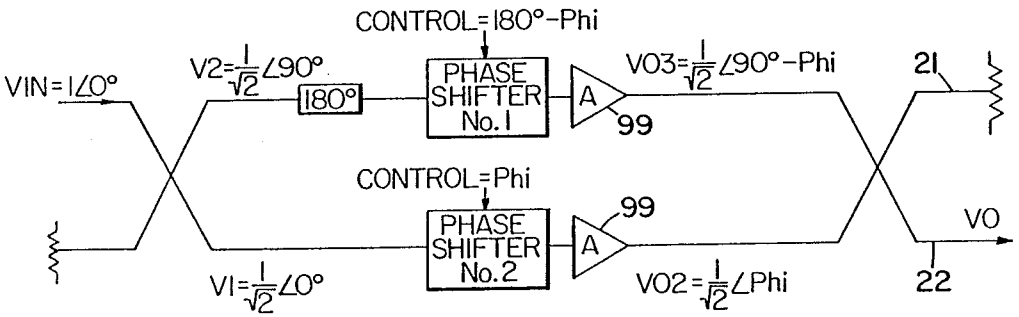
FIG. 4 shows a version of the attenuator arrangement of the invention herein additionally employing an RF amplifier in each transmission branch to establish a predetermined maximum output power level.

If, however, phase shifters 33 and 34 are set to oppositely established, selected nonzero phase settings, say for example "phi" ten (10) degress of magnitude, the shift of vectors VO3 and VO2 toward each other as suggested in FIG. 3B is reflected in an equivalent oppositely disposed phase modification of voltage vectors VO3 and VO2, having the effect of bringing them closer together by an angular amount of twice "phi", but nonetheless maintaining the phase output signal VO as shown in FIG. 3C constant and stable without any phase shift, albeit somewhat reduced in amplitude.

The resultant VO in FIG. 3C is amplitude reduced as can be seen in FIG. 3C, because the contributions from VO3 and VO2, namely VO3' and VO2' are out of phase alignment by the amount of twice the selected value of "phi", e.g. in this case twenty (20) degrees. VO2' and VO3' are twice "phi" out of phase because hybrid element 16 flips, shifts or rotates VO2 ninety degrees to produce contribution vector VO2'. In particular, as can be seen, the output voltage level VO is proportional to the cosine of the phase shift "phi" which has been introduced into arrangement 13, and 90 degrees out of phase with VIN. In particular, VO=jcos "phi"; for VIN=1.

Accordingly, the amount of attenuation can be selected by setting "phi". By including equal amplifiers 99, amplification ad attenuation can be accomplished.

Figure 5:
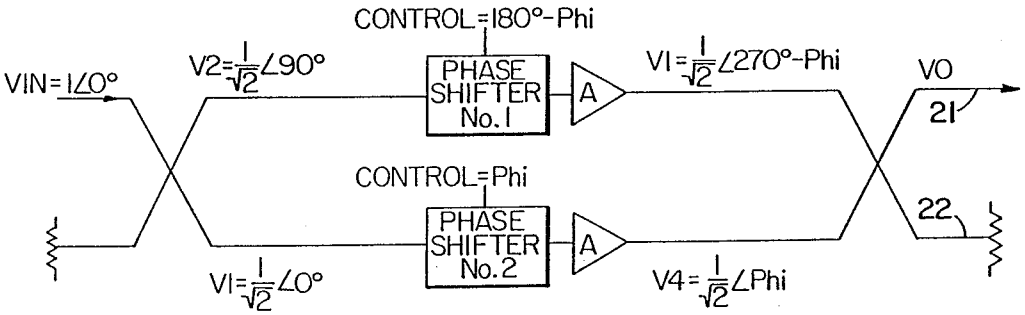
FIG. 5 shows a further version of the attenuator arrangement of the invention herein, in which the output voltage is taken at a different branch.

Further, as suggested in FIG. 5, port 21 can be selected as the port for output of VO, in lieu of port 22, port 22 accordingly being terminated. In this instance, VO=cos "phi", with VO being in phase with input VIN, the relationship being subject to the condition that VIN=1 and the gain of amplifiers 99 being 1, as well. More generally, it can be said VO is proportional to VIN times the cosine of "phi".

It should be understood that the invention is not limited to the particular embodiments shown and described herein, but that various changes and modifications may be made without departing from the spirit and scope of this novel concept as defined by the following claims.

I claim:

1. A microwave circuit for controlling the level of radio frequency power without a phase shift comprising:

input and output hybrid elements for coupling power into and out of said circuit and into and out of first and second channels for conduction equal amounts of power between said input and output hybrid elements;

first and second adjustable phase shift element, in corresponding ones of said first and second channels, for shifting the phase of power travelling therethrough by equal and opposite amounts, whereby the amplitude of power coupled out of said hybrid element may be varied by adjustment of the phase shift, characterized in that:

each of said first and second channels consists of a single conductive path for microwave power between said input and output hybrid element wherein each of said first and second paths exclude hybrid elements for splitting power;

one of said conductive paths includes a phase shifter set to shift the phase of power passing therethrough by a quantity phi; and the other of said conductive paths includes a fixed phase shifter for shifting the phase of power passing therethrough by one hundred eighty degress and a phase shift element set to shift said phase by an amount equal to one hundred eighty degrees minus phi.

2. A circuit according to claim 1, further characterized in that each of said paths includes an amplifier having a predetermined gain that is the same for both of said amplifiers, whereby said circuit may increase or decrease the amount of power exiting from said output hybrid element without phase shift.

* * * * *